US012064679B2

(12) United States Patent
Huang et al.

(10) Patent No.: US 12,064,679 B2
(45) Date of Patent: Aug. 20, 2024

(54) EXERCISE EQUIPMENT WITH INTERACTIVE REAL ROAD SIMULATION

(71) Applicants: WUG ROBOT LLP, Carmel, IN (US); Pu Huang, Carmel, IN (US); Yixu Huang, Carmel, IN (US)

(72) Inventors: Pu Huang, Carmel, IN (US); Yixu Huang, Carmel, IN (US)

(73) Assignee: WUG ROBOT LLP

( * ) Notice: Subject to any disclaimer, the term of this patent is extended or adjusted under 35 U.S.C. 154(b) by 163 days.

(21) Appl. No.: 17/777,735

(22) PCT Filed: Nov. 24, 2020

(86) PCT No.: PCT/US2020/062075

§ 371 (c)(1),
(2) Date: May 18, 2022

(87) PCT Pub. No.: WO2021/108443

PCT Pub. Date: Jun. 3, 2021

(65) Prior Publication Data

US 2023/0001282 A1 Jan. 5, 2023

Related U.S. Application Data

(60) Provisional application No. 62/940,195, filed on Nov. 25, 2019.

(51) Int. Cl.
*A63B 71/06* (2006.01)
*A63B 24/00* (2006.01)

(52) U.S. Cl.
CPC ..... *A63B 71/0622* (2013.01); *A63B 24/0087* (2013.01); *A63B 2024/009* (2013.01); *A63B 2024/0093* (2013.01); *A63B 2071/0644* (2013.01); *A63B 2071/0677* (2013.01); *A63B 2220/05* (2013.01); *A63B 2220/12* (2013.01);
(Continued)

(58) Field of Classification Search
CPC ..... A63B 71/0622; A63B 24/0087; A63B 2024/009; A63B 2024/0093; A63B 2071/0644; A63B 2071/0677; A63B 2220/05; A63B 2220/12; A63B 2220/18; A63B 2220/30; A63B 2220/806; A63B 2071/0666; A63B 22/02;
(Continued)

(56) References Cited

U.S. PATENT DOCUMENTS 7,217,224 B2 * 5/2007 Thomas ..... H04L 67/12 482/8
9,288,368 B2 * 3/2016 O'Sullivan ..... H04N 5/04
(Continued)

*Primary Examiner* — Garrett K Atkinson
(74) *Attorney, Agent, or Firm* — Gutwein Law; Tyler B. Droste

(57) ABSTRACT

An intelligent interactive real road simulation training device that simulates the real road grade and slope change while playing video based on the geographic location of the road from the pre-processed video and the speed of the user. With the video playing, the user sees the road moving as the user moves, and the speed of the road moving by is based upon the user's speed on the exercise training equipment. The user also feels the grade and slope change as the road grade and slope changes on the video. The invention can be integrated into any exercise training equipment such as a bicycle trainer or treadmill.

20 Claims, 11 Drawing Sheets

(52) U.S. Cl.
CPC ..... *A63B 2220/18* (2013.01); *A63B 2220/30* (2013.01); *A63B 2220/806* (2013.01)

(58) Field of Classification Search
CPC .... A63B 2071/0638; A63B 2071/0663; A63B 2220/58; A63B 2225/50; A63B 69/16; A63B 22/0664
See application file for complete search history.

(56) References Cited

U.S. PATENT DOCUMENTS

| | | | | |
|---|---|---|---|---|
| 2004/0102931 | A1* | 5/2004 | Ellis | A61B 5/0833 702/188 |
| 2005/0239601 | A1* | 10/2005 | Thomas | A63B 24/00 482/8 |
| 2007/0061076 | A1* | 3/2007 | Shulman | G06T 7/97 701/500 |
| 2009/0011907 | A1* | 1/2009 | Radow | B62M 3/00 482/57 |
| 2009/0098524 | A1* | 4/2009 | Walton | G09B 5/14 434/350 |
| 2010/0269143 | A1* | 10/2010 | Rabowsky | H04B 7/18591 725/63 |
| 2014/0049636 | A1* | 2/2014 | O'Donnell | H04N 21/4621 348/143 |
| 2015/0098021 | A1* | 4/2015 | O'Sullivan | H04N 21/4223 348/516 |
| 2016/0271796 | A1* | 9/2016 | Babu | B25J 9/1664 |
| 2017/0034430 | A1* | 2/2017 | Fu | H04N 23/70 |
| 2018/0255233 | A1* | 9/2018 | Shibata | H04N 23/695 |
| 2022/0347548 | A1* | 11/2022 | Watterson | A63B 22/0235 |

* cited by examiner

EXERCISE EQUIPMENT WITH INTERACTIVE REAL ROAD SIMULATION

CROSS-REFERENCE TO RELATED APPLICATION

This patent application claims priority to U.S. Provisional Application 62/940,195 filed Nov. 25, 2019, the disclosure of which is considered part of the disclosure of this application and is hereby incorporated by reference in its entirety.

FIELD OF THE INVENTION

The invention relates to exercise equipment with intelligent interactive real road feel that simulates the actual real road grade and slope change while playing road video based on the geographic position of the road from the pre-processed video and the speed of the user.

BACKGROUND

Most existing training or exercise equipment, including treadmills and stationary bicycles, include simulation of natural terrains through pre-programmed profiles that do not include video. As such, the pre-programmed profiles may include tilt up or tilt down on treadmills or pedal resistance changes on stationary bicycles, but they are not related to a road or path shown on video. iFit is a video subscription service for exercise equipment that shows personal trainers taking actual real world paths but the link between the video and the exercise equipment is non-existent. RunTV shows real world paths with and without coaches; this system will adjust speed of video based upon footfall speed on exercise equipment. At YouTube.com, some training videos display the video of the real road with beautiful music but are not interactive with the exercise equipment.

For bicycle trainers, U.S. Pat. No. 6,004,243 discloses adjusting a training video to pedal speed. Going further, US Patent Application 2014/0171266 A1 the dynamic variables which are set using computing device 1904 are updated on an as needed basis and may frequently change during a workout. As an example, the grade of a bicycle path and a wind speed may be constantly changing throughout a workout as a user rides on a windy, hilly, simulated course. Thus, the bicycle trainer will continually update a power set point based on the variables received from a computing device and the instantaneous speed of the rider based on the rider's pedaling of the bicycle trainer. The bicycle trainer is able to control the feel of a ride through electromagnetic resistance to simulate a windy hill climb by increasing the electromagnetic resistance (and then reducing the electromagnetic resistance when descending the hill or experiencing a strong tail wind).

BRIEF SUMMARY OF THE INVENTION

There are some training devices that can simulate virtual road like what you can experience in a bike or car racing game, but they cannot really simulate the grade/slope of the road because the road itself is virtual but not real.

In one embodiment, a video playback and interface system for exercise training equipment is provided wherein the location, speed and slope data are gathered during the video recording of an actual exercise path and the gathered data is further processed to provide a simulated exercise experience of the video.

In another embodiment, the connected exercise training equipment is an exercise bicycle, treadmill, rowing machine or swim trainer.

In another embodiment, the video playback speed is determined by exercise training equipment speed. In a further embodiment, the video playback speed is continuously variable.

In another embodiment, the resistance on or incline of the exercise training equipment is determined by wind resistance, road friction resistance, gravity and slope. In a further embodiment, the determined wind resistance and road friction resistance are affected by the speed of the exercise equipment.

In another embodiment, the user controls the video system by mobile device, desktop computer or controller integrated with the exercise training equipment.

In another embodiment, the user resumes a previous ride at the previous end point stored in memory.

In a separate embodiment, a video editing process is provided wherein the actual recording vehicle moving speed, video recording speed and target constant vehicle recording moving speed are used to modify the original video file to produce an edited recording with a constant target moving speed.

In another embodiment, the actual recording vehicle can be any moving object including motorized vehicle, non-motorized vehicle, motorized boat, non-motorized boat, drone or human being.

In another embodiment, the preferred constant moving distance per frame is calculated based on video recording speed (frame/second) and preferred constant recording moving speed (meter/second).

In another embodiment, the video is edited in sections that is determined whenever the difference between actual recording vehicle speed and target recording vehicle speed changes between two of zero, negative and positive.

In another embodiment, the preferred distance between each frame and section starting frame is calculated based on preferred constant moving distance per frame.

In another embodiment, the actual distance between each frame and section starting frame is calculated.

In another embodiment, the actual distance and preferred distance between each frame and section starting frame are compared with the actual frames with distance closest to preferred frame kept.

In another embodiment, frames in a section will be removed when the actual recording vehicle moving speed is slower than the preferred constant recording moving speed in the section.

In another embodiment, frames in a section will be added when the actual recording vehicle moving speed is faster than preferred constant recording moving speed in the section.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
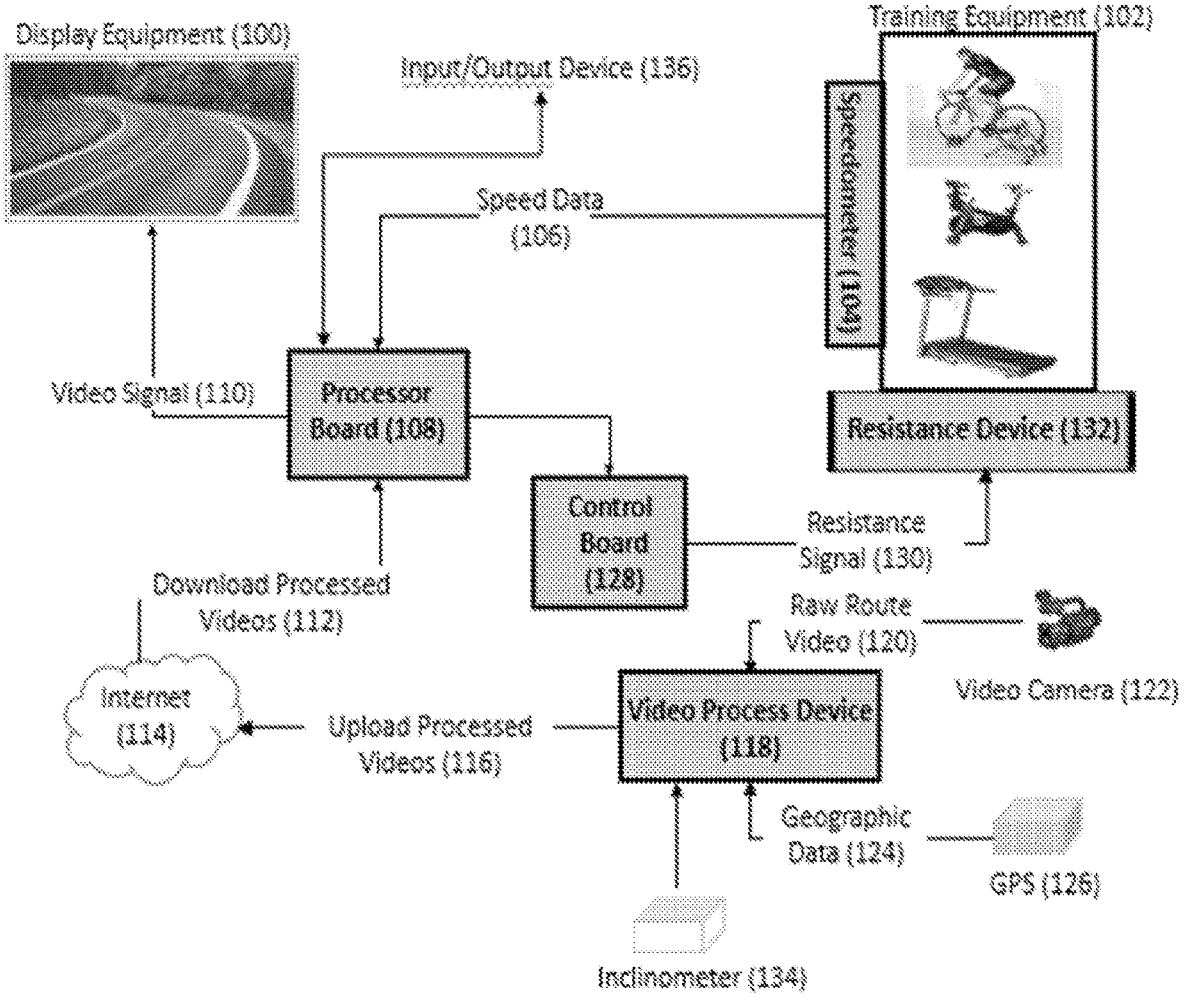
FIG. 1 depicts an overview of the inventive system that interfaces a video to an exercise trainer.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The video playback and interface system for exercise training equipment is described herein.

In general, FIG. 1 depicts an overview of an example of the inventive system that interfaces a video to exercise training equipment 102. The exercise training equipment 102 may be any such equipment including recumbent or upright bicycle trainer, bicycle on flywheel trainer, and treadmill. A speedometer 104 attached or part of exercise training equipment 102 provides speed date to a processor board 108. The processor board 108 also receives input from a downloaded processed video 112. The downloaded video 112 may be stored on the internet 114, a portable or computer hard drive, USB memory, CD, DVD or another video storage medium. The downloaded video 112 was processed by a video process device 118 which then uploaded the processed video 116 to the internet 114 or other video storage medium. The video process device 118 gets its input from the raw route video 120 shot on a video camera 122 and from geographic data 124 obtained through global positioning satellite detectors 126 or other location and slope determination means including cellular mobile communication (such as 2G, 3G, 4G and 5G networks), Bluetooth Low Energy, WiFi, Near Field Communication (NFC), Ultra Wideband (UWB), or other radiofrequency means and inclinometer. The geographic data consists of latitude and longitude and may also include altitude. The video process device 118 may also be connected to an inclinometer (134) to record slope data along the route; processing of altitude data from GPS may also provide similar information but altitude information requires connection to additional satellites for triangulation, which may not be available in all locations.

The display equipment 100 may be a mobile phone, tablet, glasses, smart watch, projector, television, video monitor or any other device capable of displaying video content.

The processor board 108 uses the speed data 106 to continuously adjust the speed of the video displayed on the display equipment 100 by sending the video signal 110. The processor board 108 also provides data to the control board 128 that determines the resistance or incline needed for the exercise training equipment 102. For example, a resistance signal 130 is sent by control board 128 to a resistance device 132 attached to the exercise training equipment 102. The resistance device 132 may be built into the exercise training equipment 102 or may be an external device attached to the exercise training equipment 102. The processor board 108 also receives input from an input/output device 136; the input/output device may be the same as the display equipment 100, such as a smartphone or tablet, or may be any separate device attached or not attached to the exercise equipment capable of having a user input information and possibly having the input information provided back to the user for confirmation. A display may be provided on input/output device 136 but output may be through display equipment 100 instead. The user of the training equipment uses input/output device 136 to enter any information requested by the system. Such input can include name, age, proficiency level, start, stop, route desired, whether to resume a previously saved ride, and whether to save the present ride. The system setup and configuration may also be entered through the input/output device 136.

The video camera 122 may be handheld or affixed to a vehicle or an individual.

The speed by the speedometer 104 may be determined by any means including by electronics, magnets or mechanical detection.

In FIG. 1, input/output device 136, processor board 108, display equipment 100, control board 128, video process device 118, video camera 122, GPS 126 and inclinometer 134 are depicted as separate entities; however, any two or more may be combined into one or more discrete hardware devices. For example, a smartphone or tablet may be used for all the listed entities. On the other hand, the video recorder may be a separate device to record higher resolution and higher speed (higher frames/second) video than a smartphone or tablet may be able to do.

Figure 2:
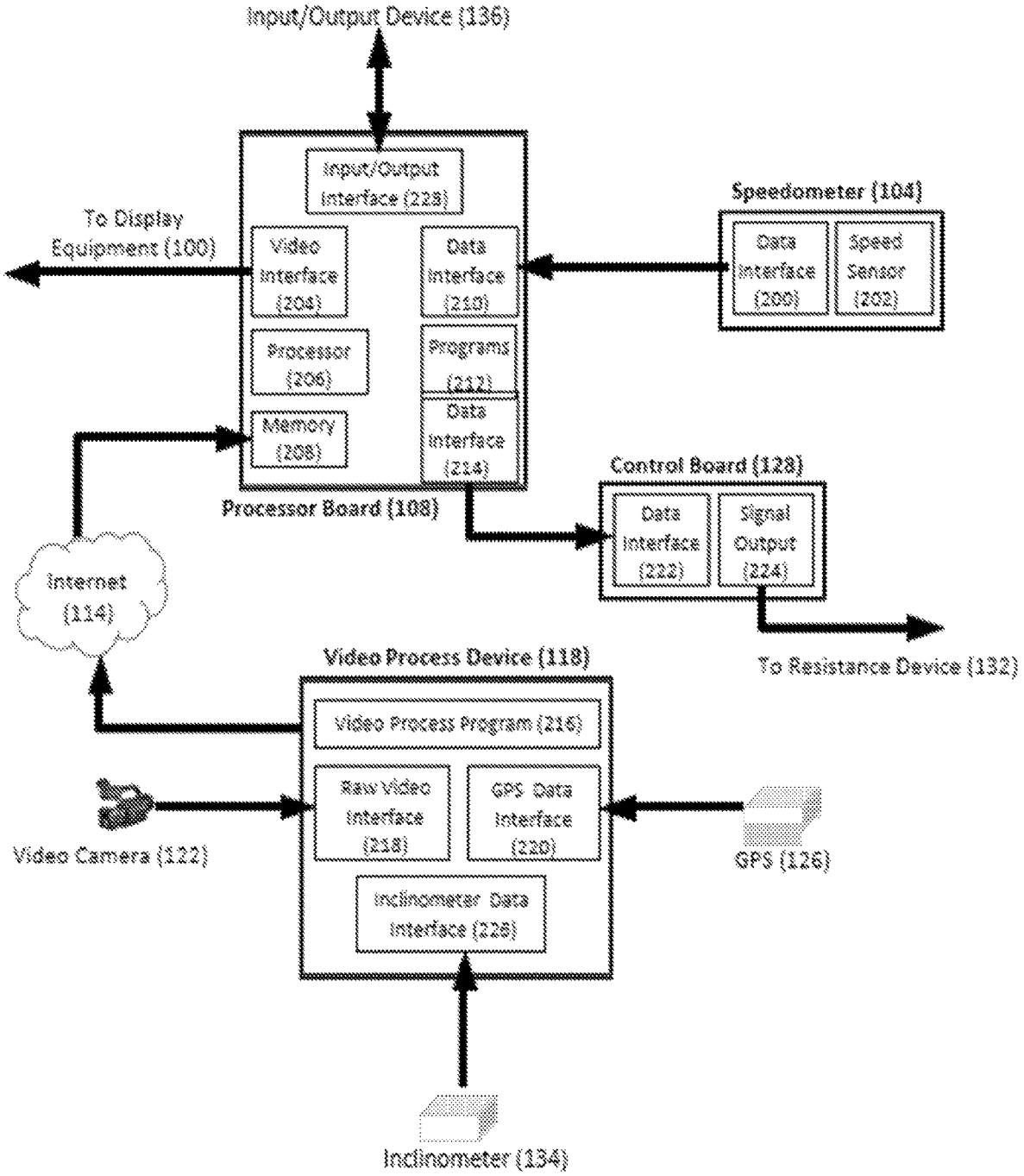
FIG. 2 depicts the specific components within the general components that interface a video to an exercise trainer.

FIG. 2 depicts one possible set of components for items shown in FIG. 1. In one possible arrangement, speedometer 104 has a speed sensor 202 with a data interface 200 that sends the data to a like data interface 210 in the processor board 108. In a possible arrangement, the video process device 118 receives raw video input through a data interface 218, GPS or geographic data input through another data interface 220, and inclinometer data input through the inclinometer data interface 226. The data received by 218, 220 and 226 are then processed by a video process program 216, which then uploads the processed video to the internet 114. The processed video is then downloaded and stored in the processor board memory or storage 208. The processor board 108 also has a video interface 204 that sends the video data to display equipment 100, a processor 206 that runs off programs 212 using video data, speed data and inclinometer data in memory 208 and data interface 210, and a data interface 214 that sends data to a data interface in control board 128. Processor board 108 also takes input from input/output device 136 through the input/output interface 228 for use in programs 212 and for display on either display equipment 100 or input/output device 136. Control board 128 also determines and has a signal output 224 that goes to a resistance device 132 or an inclinometer.

Figure 3:
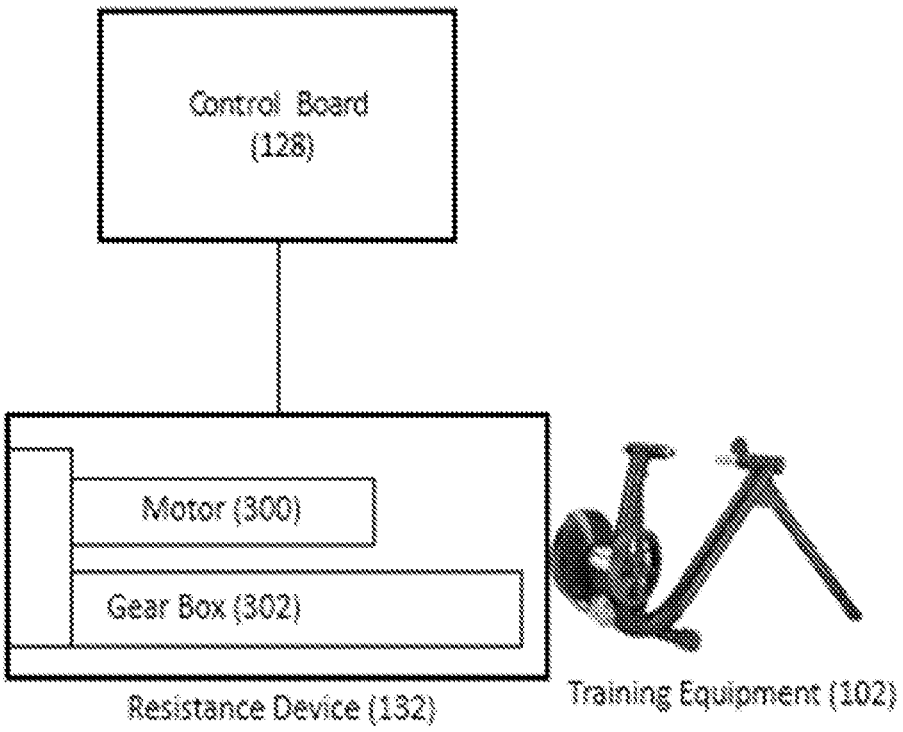
FIG. 3 depicts general components of a resistance device for an exercise trainer.

In FIG. 3, the control board 128 output signal is sent to resistance device 132 that in one possible arrangement has a motor 300 and a gear box 302. The resistance device 132 is directly attached to the exercise training equipment 102. The motor and gear box may be of any type and may provide resistance to the training equipment by any means including friction or gear engagement. Another possible arrangement is for motor (300) to be a linear or step motor that moves one or multiple permanently installed magnets close to or farther away from the spinning disk that creates resistance. Another possible arrangement is that the resistance device (132) generates resistance fully using an electromagnet, which in this case both motor (300) and gear box (302) are not needed, and the resistance is adjusted by electric current controlled by a signal from the control board (128).

Figure 4:
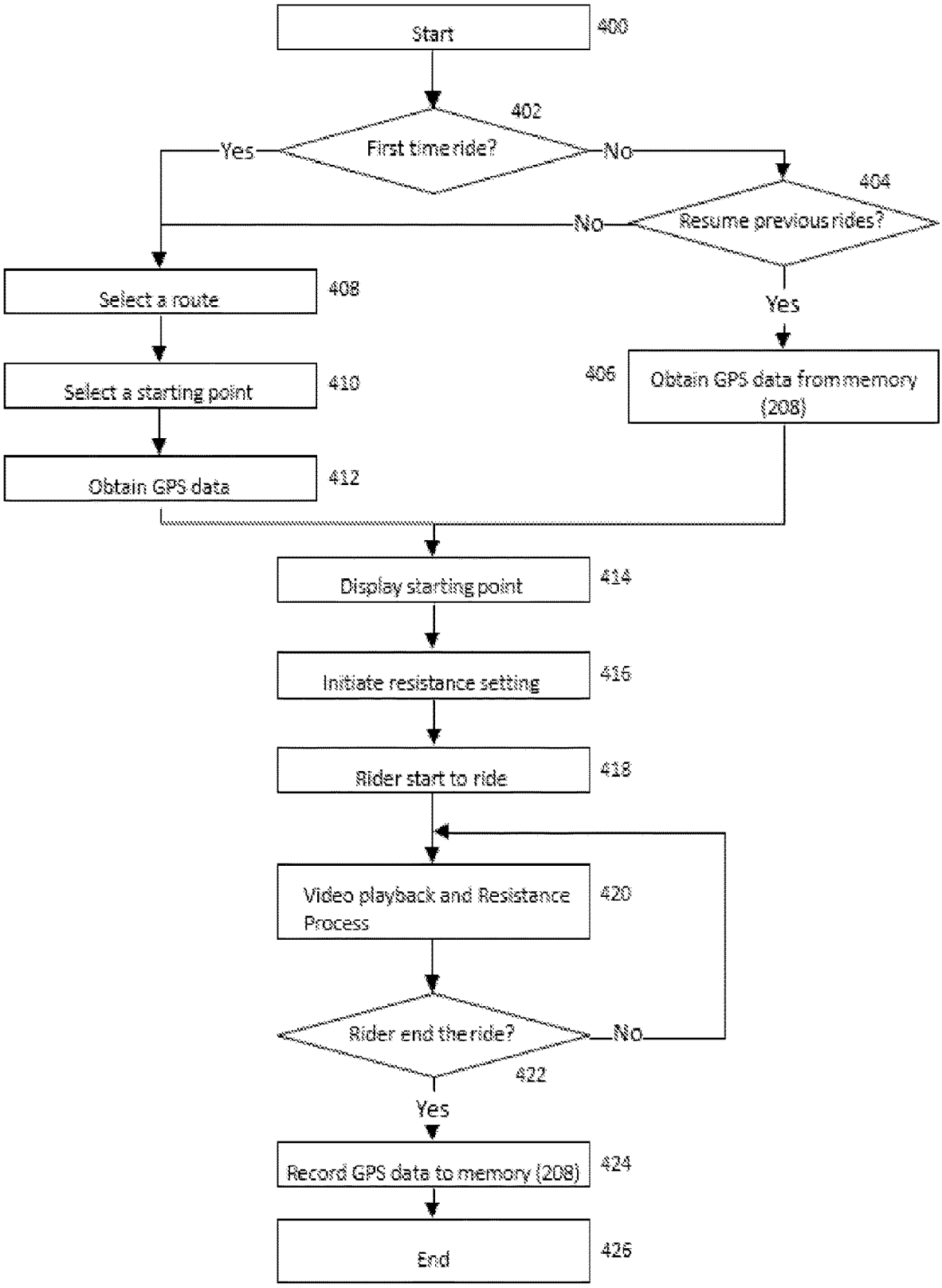
FIG. 4 depicts a flowchart of general steps for a user interacting through an input/output device and display equipment with the inventive system for an exercise trainer.

In FIG. 4, one possible flow for the exercise equipment trainer user interface is provided. This example is for a bicycle trainer, but a similar flow can be provided for a treadmill or other exercise equipment trainer. The exercise equipment trainer user starts the controller at 400 and is asked if this a first ride at 402. If the answer is no, then the user is asked if previous rides should be resumed at 404. If yes, then data on the stopping point of the previous ride is retrieved from memory 208 at 406. If the previous ride is not to be resumed, then the user selects a route at 408 and a starting point at 410. The controller then retrieves route data from memory 208 at 412.

Once the data for a resumed ride or a new ride is retrieved, the starting point is displayed at 414 and an initial resistance is set at 416. The user starts to ride at 418 and the processor board 108 starts and performs continuous video playback speed and resistance processing at 420. When the user ends the ride at 422, the final GPS data is stored in memory 208 at 424 and the ride ends at 426.

Figure 5:
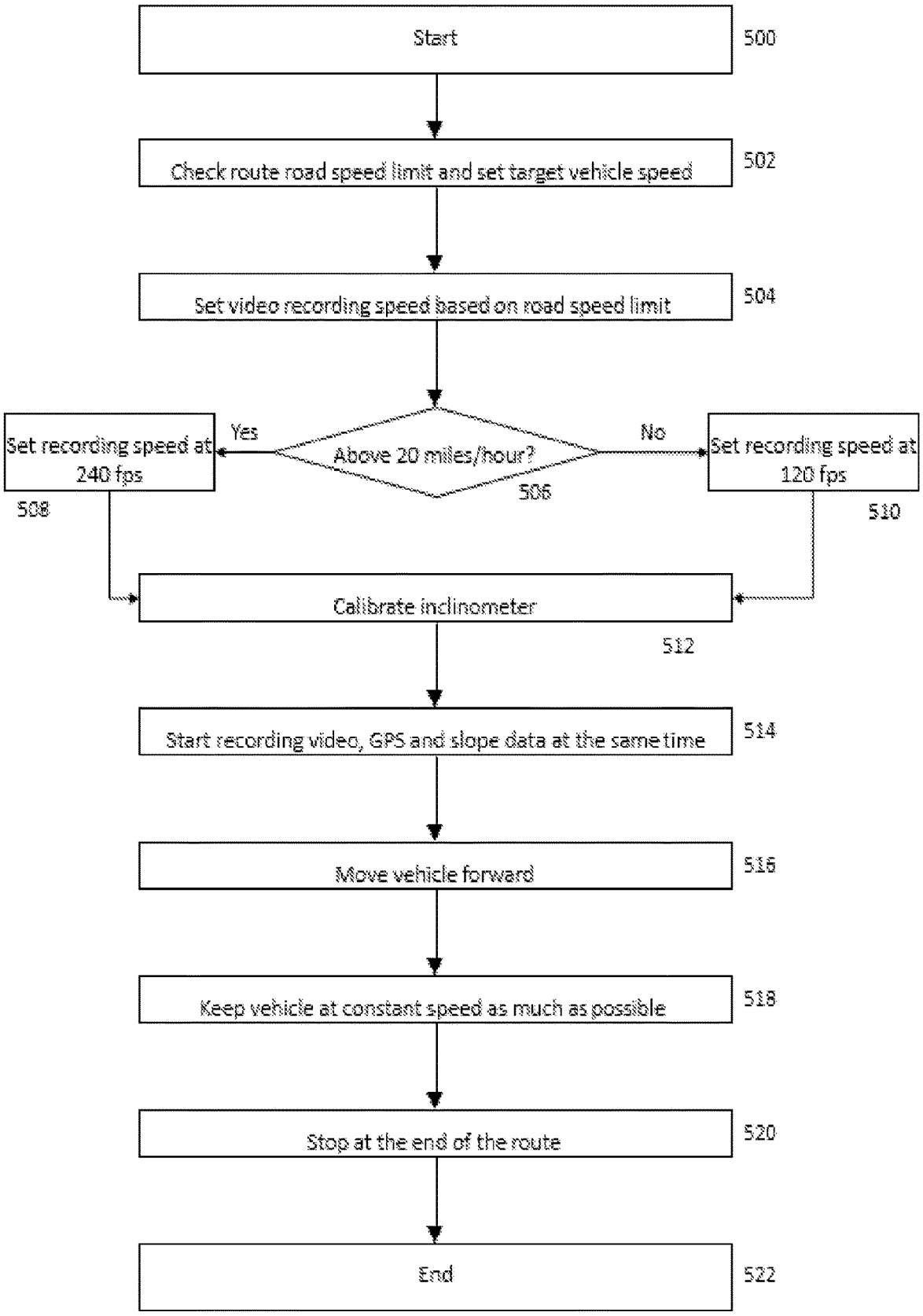
FIG. 5 depicts a process flow for recording a video for use with an exercise trainer.

FIG. 5 is one possible flowchart for recording a video. The example provided is for a route on a road but may be modified for any actual path, including trail or waterway. When preparing to video record a route at 500, the route road speed limit is checked and a target vehicle speed for recording is determined at 502. The video recording speed may be determined based upon the road speed limit, the vehicle speed or another factor at 504. In FIG. 5, the chosen speed as an example is 20 miles per hour at 502. If the speed is above 20 miles per hour, then the recording speed is set at 240 frames per second or if the speed is below 20 miles per hour, then the recording speed is set at 120 frames per second. In actuality, the speed limit or vehicle speed for determining recording speed can be any value other than 20 miles per hour and the chosen recording speed can be any that is feasible. The recording speed may be any feasible speed though the ultimate goal is to have a high definition video that can be displayed without pixelation, skipping or other poor video quality characteristics; the high definition video should be able to be displayed at any playback speed. An inclinometer is calibrated at 512 and the video recording, GPS data and inclinometer data recording begin simultaneously at 514, the vehicle moves forward at 516 and maintain a constant speed at 518. The vehicle stops, along with video and incline data recording, at the end of the route (520) with process end at 522. At 514, actual speed data may also be recorded for use in video processing. A step may be needed to calibrate the GPS and speed device prior to video recording process.

Figure 6:
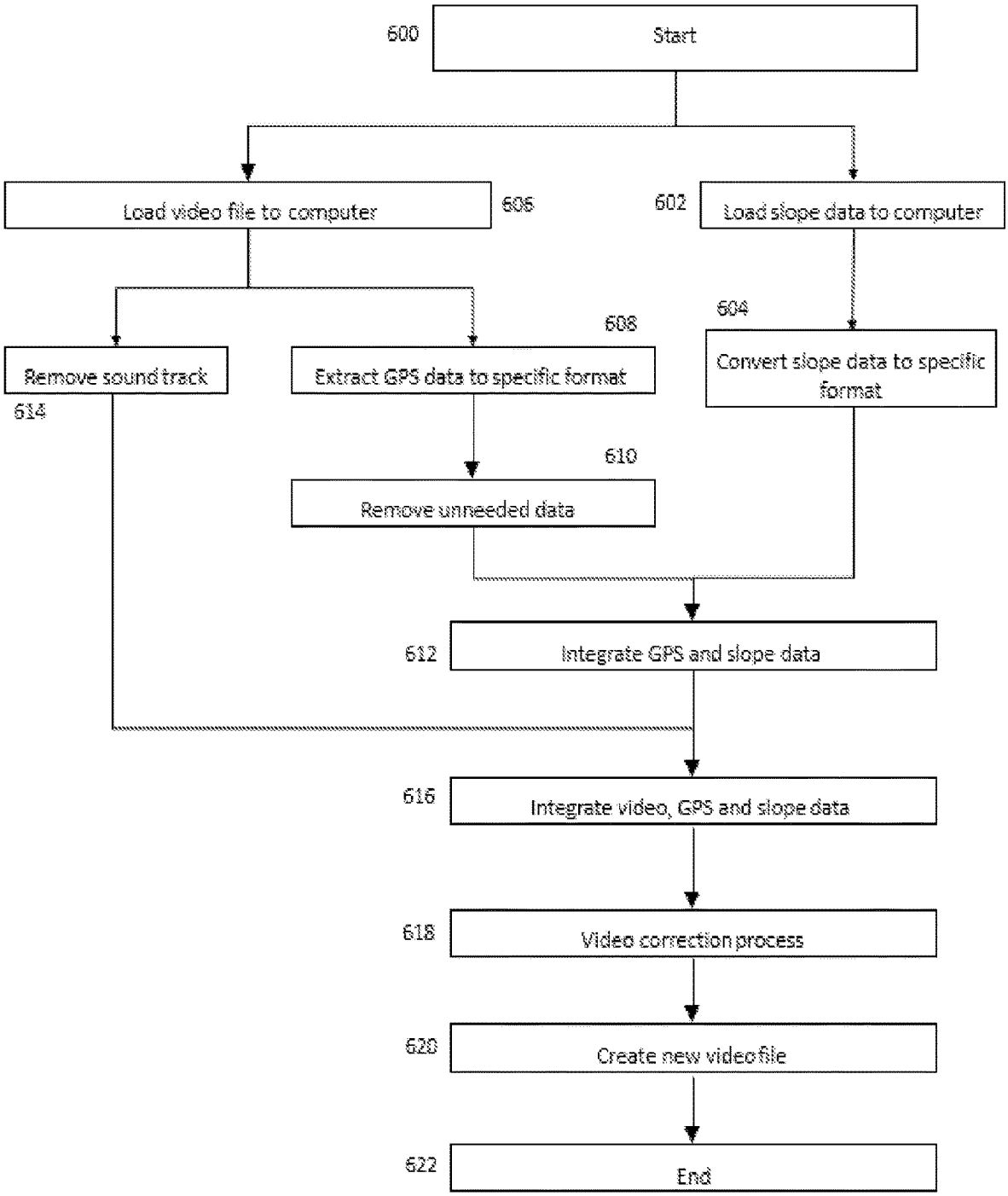
FIG. 6 depicts a process flow of data processing for a video recorded for use with an exercise trainer.

In FIG. 6, one possible flowchart for processing videos is provided. At the start 600, the slope data and video file are loaded to the computer at 602 and 606, respectively. The slope data is converted to a usable format at 604. For the video file, the GPS data is extracted and converted to a usable format, typically the same format as the slope data, at 608; unneeded data is removed at 610 and the GPS and slope data are then integrated together. If a sound is recorded in the video recording, the sound is removed at 614.

The video without sound is then integrated with the combined GPS and slope date at 616. Data integration may form a single data file or data packet with both video and slope data or a package with a separate video file and one or more slope data files. A manual video correction is then performed at 618; further details are provided in FIG. 7. A final revised video file is created at 620 and the video is now ready for use at 622.

Figure 7:
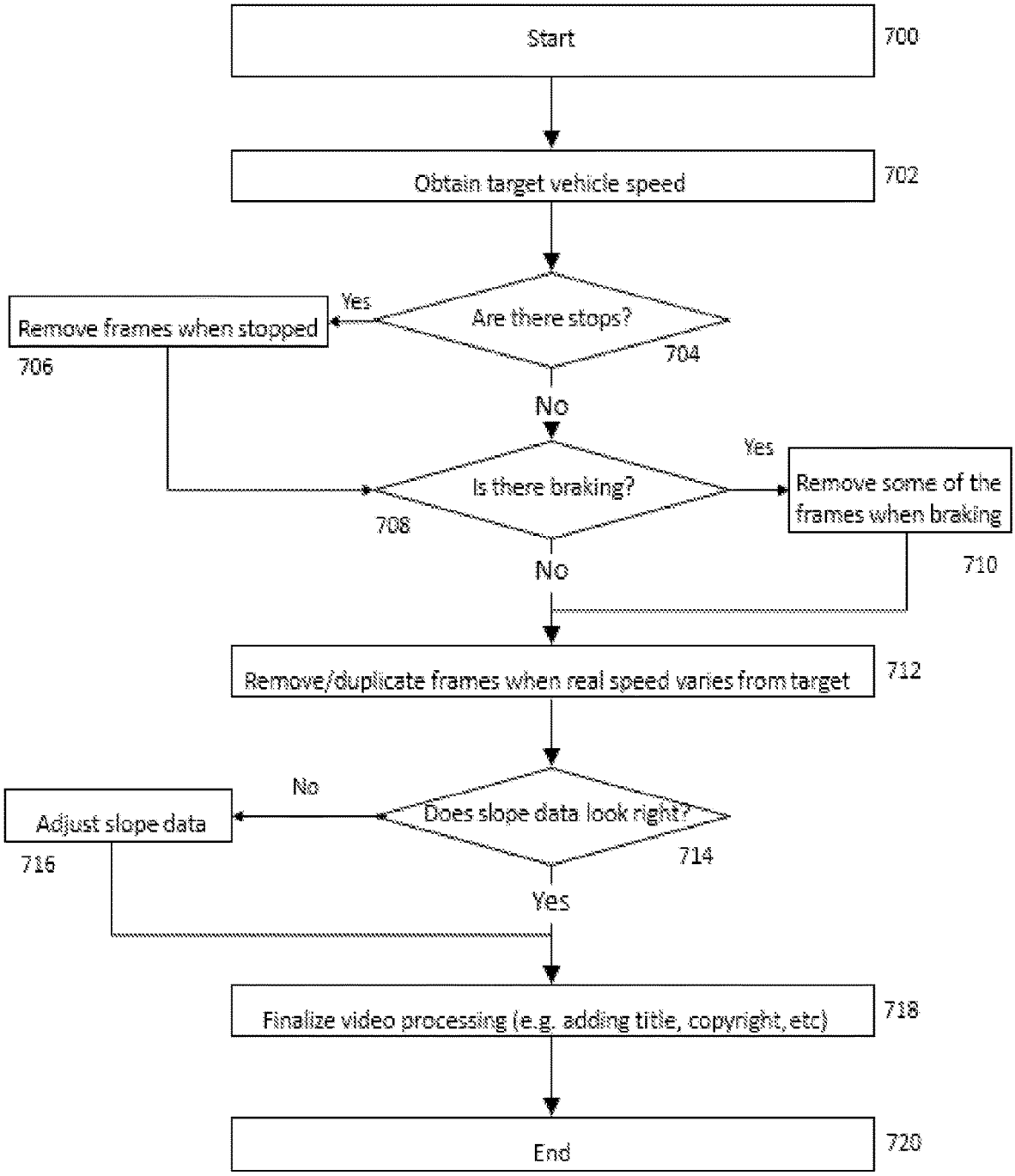
FIG. 7 depicts a process flow for editing of a recorded video for use with an exercise trainer.

In FIG. 7, one possible flowchart for video correction editing is provided. This video correction editing can be done either manually or through computer programs, it will not always be needed but circumstances during recording may require this process. When video correction editing is determined to be needed at 700, recall the target vehicle speed at step 702 from FIG. 5 step 502. Determine if any unintended stops were made at 704. If yes, then remove the video frames when stopped. Then determine if there were any unnecessary hard braking at 708. If yes, then remove some of the frames when braking hard at 710. At 712, add or remove frames to correct for actual vehicle speed versus target vehicle speed; if the actual vehicle speed was faster than target vehicle speed, then frames will need to be added and vice versa if the actual vehicle speed was slower than target.

As an alternative to removing or duplicating frames at 712, the actual speed data can be used to adjust playback speed variably; if the actual speed is faster than target speed, then the playback can be slowed to simulate the target speed and vice versa if the actual speed is slower than the target speed. However, in the former case, resolution may be lost in the video playback as less frames are displayed or shown per time unit.

At 714, determine if the slope data is correct. If not, then adjust the slope data at 716. Once all this is completed, then finalize the video by adding any desired additional content at 718; the additional content can include title, copyright, production company, recording location, video editor and camera operator. The video is completed at 720.

Figure 8:
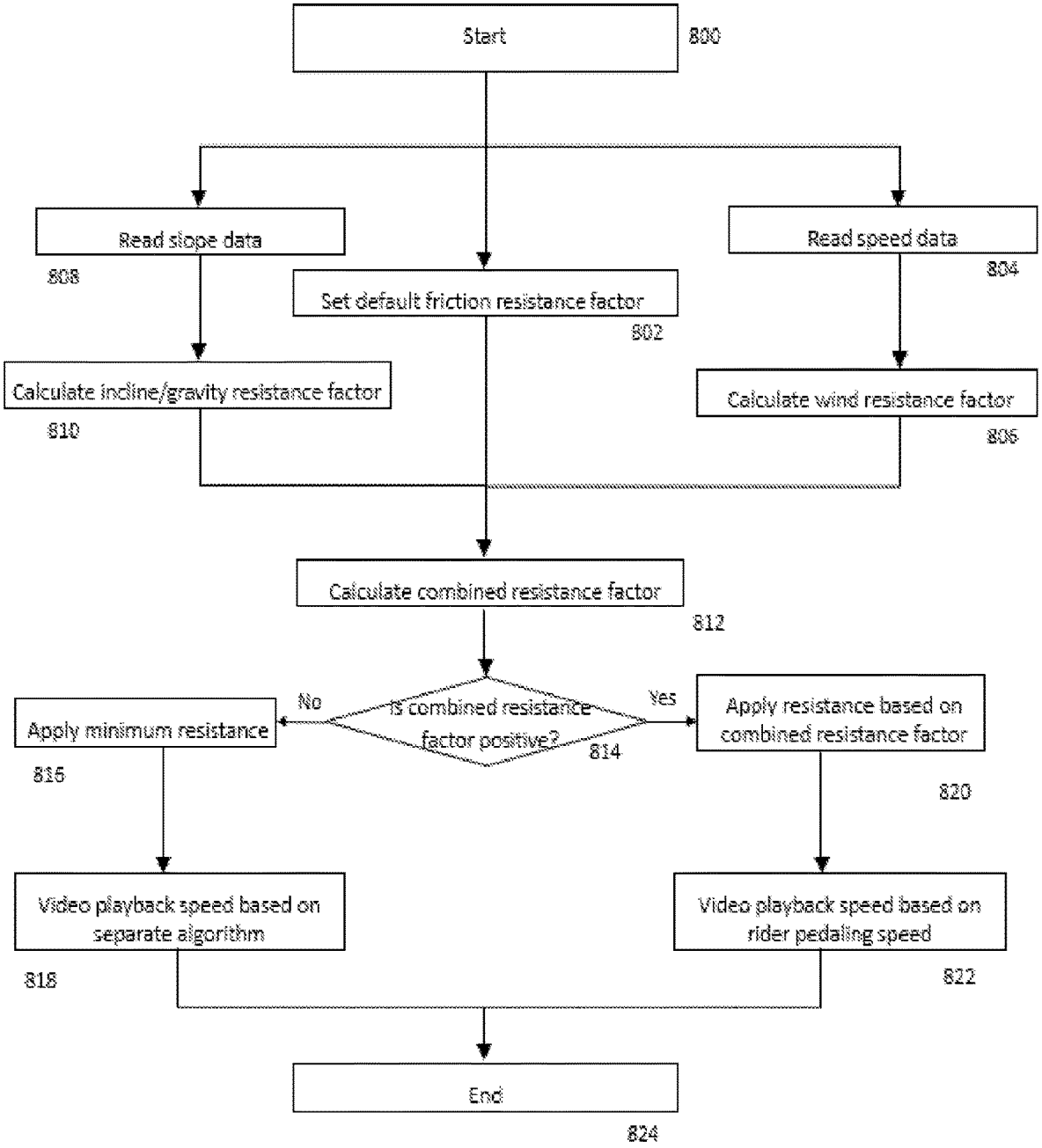
FIG. 8 depicts a process flow for determining the resistance to place on an exercise trainer.

In FIG. 8, one possible flowchart for setting the resistance and video playback is provided; a similar process flow can also be envisioned for setting incline, such as on a treadmill. At the start 800, a default friction resistance factor is set at 802, speed data is read at 804 and a wind resistance factor is determined from the speed data at 806. Slope data is read at 808 and an incline or gravity resistance factor is determined from the slope data at 810. The friction, wind and incline or gravity resistance factors are then used to calculate combined resistance factor at 812, this process provided occurs continuously to provide a continuously changing resistance on the exercise training equipment as the incline, speed and friction change.

In some situations, especially when the actual road has a long steep downhill section, the gravity force may become so big that it will pull the bike forward despite all combined resistance. In these situations, the combined resistance factor can be zero or negative and impacts the video playback speed. Thus at 814, a determination is made what resistance factor to apply based upon the combined resistance factor. If the combined resistance factor is positive, the combined resistance factor is applied at 820 and the video playback speed will be determined by the rider pedal speed at 822. However if the combined resistance factor is zero or negative, the gravity force may pull the bike faster than the rider pedal speed and a minimal resistance may be applied at 816 with the video playback speed will then be decided by a separate algorithm at 818.

Figure 9:
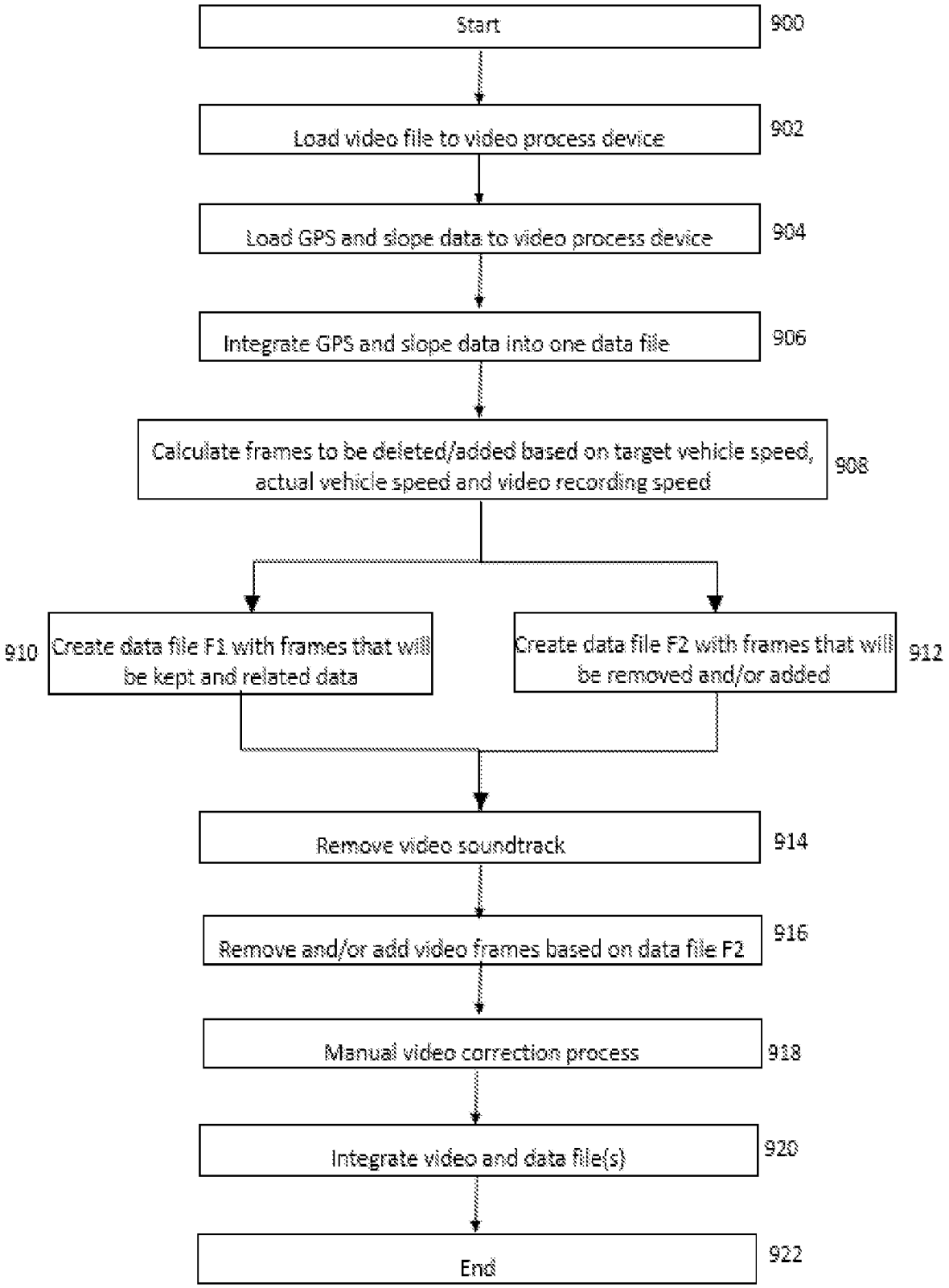
FIG. 9 depicts an overall process flow for editing a recorded video for use with an exercise trainer.
Figure 11:
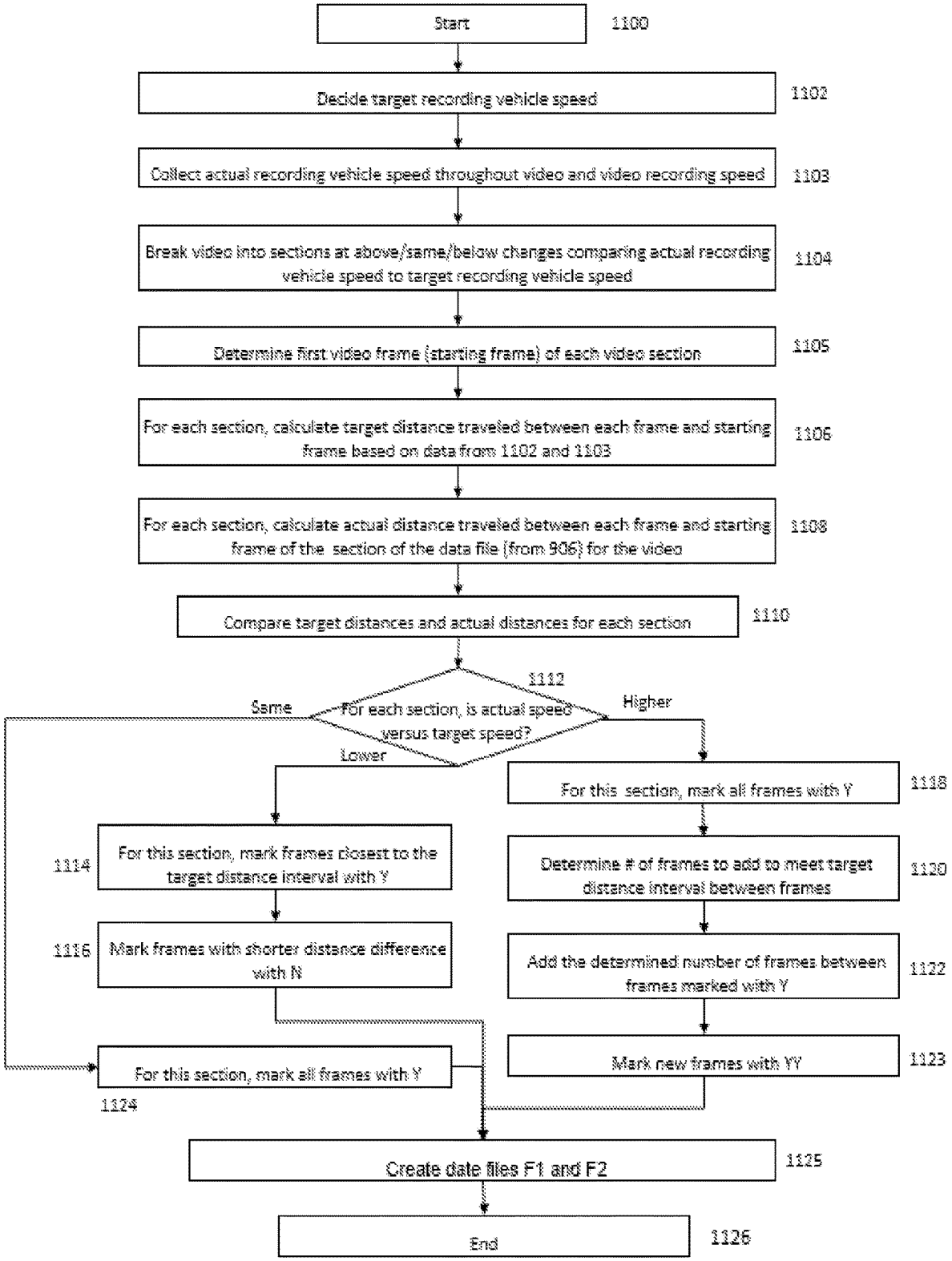
FIG. 11 depicts a detailed process flow for processing of a recorded video before manual correction process.

In FIG. 9, a flow diagram for another possible scheme for processing videos is provided. At the start (900), the video, GPS and slope data are loaded to the video process device at 902 and 904, respectively. Then GPS and slope data are integrated at 906. Based on the target vehicle speed, actual vehicle speed and video recording speed, a decision is made as to whether frames are to be kept, removed or added at 908; FIG. 11 provides one possible method for doing this. After 908, one data file F1 with frames and their related data that will be kept or added is created at 910. Another data file F2 with frames that will be removed or added is created at 912. After the soundtrack is removed from video at 914, frames will be removed or added to the video file at 916 based on data files F1 and F2.

Figure 10:
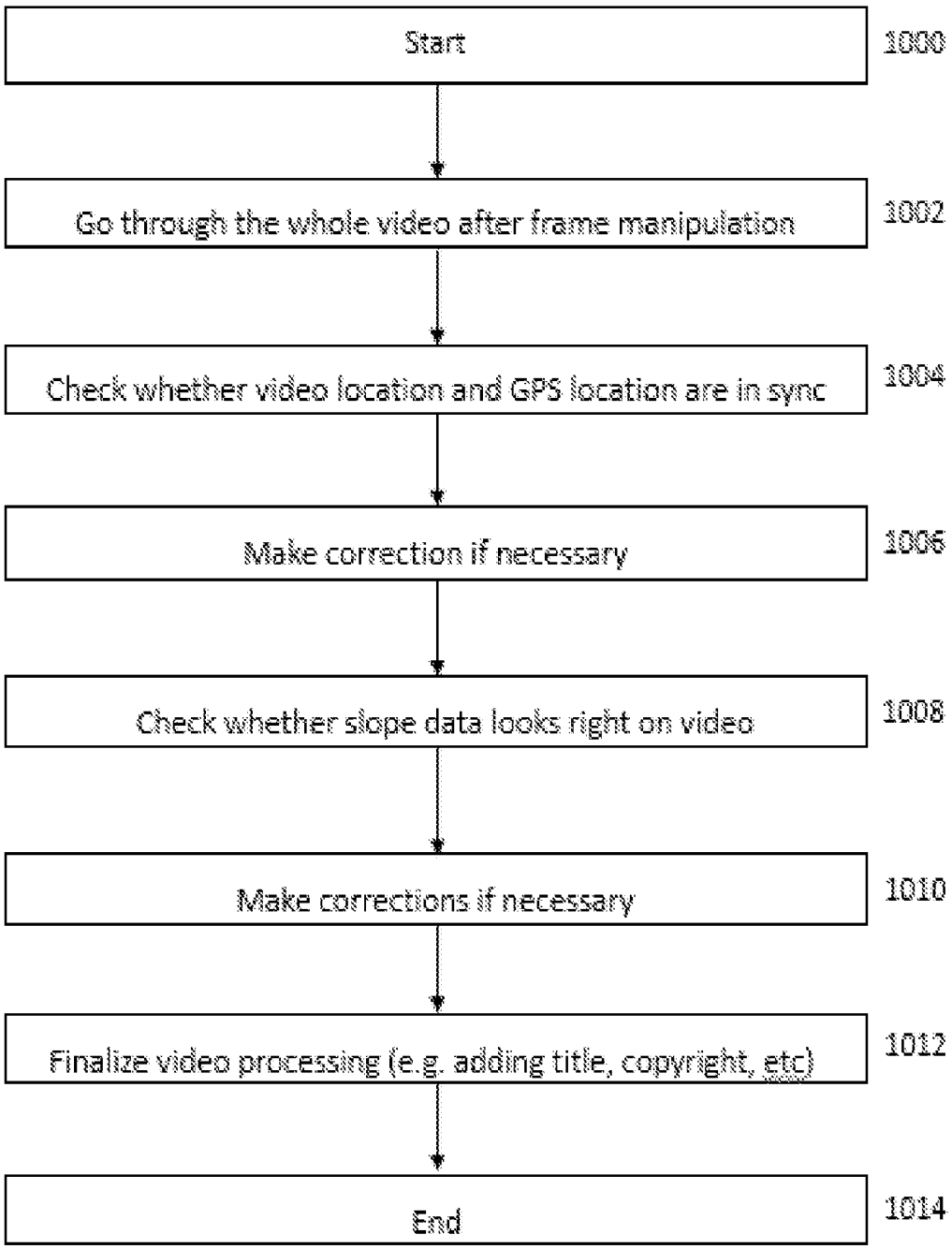
FIG. 10 depicts a process flow for manual correction of a recorded video after main video processes are completed.

A manual video correction is then performed at 918; one possible method for the manual video correction is provided in FIG. 10. The video without sound is then integrated or packaged with data file F1 and other possible other file(s) at 920. Data integration may form a single file or packet with both video and speed and slope data or a data package with a separate video file and one or more data files. After 920, a final data file or data package is now ready for use at 922.

In FIG. 10, another possible flowchart for a manual video correction process is provided. This video correction process provided is manual, but the editing can be done either manually or through computer programs. This video correction process will not always be needed but special circumstances, e.g. when slope changes dramatically like going uphill to downhill within the distance of the slope measurement interval, during recording may require this process. When video correction process is determined to be needed at 1000, the whole video will be viewed and checked manually at step 1002. At 1004, the displayed video location will be compared with geographic location from data file to check whether video and data are in sync from the beginning to the end. If there is anything not in sync, correction must be done at 1006. At 1008, the slope displayed in the video will be compared with the slope data from the data file to validate the slope data. Other geographic data resources may be used for the validation if needed. If there is any place in the video where the slope data cannot pass the validation, a correction must be done at 1010.

Once all this is completed, the video is finalized by adding any desired additional content at 1012; the additional content may include any video, audio or graphics content, e.g., title, copyright, production company, recording location, video editor and camera operator, rolling credits, and bloopers. The video is completed at 1014.

In FIG. 11, additional details are provided on how a video may be processed at step 908 in FIG. 9. Using the process outlined in FIG. 11, video viewers (e.g. riders) may move forward at different speeds and may even make a stop and then move again at any place and time; following the process in FIG. 11 for editing of the exercise video ensures that users have a high quality video and interactive experience in any use situation. Thus, adjusting the potentially inconsistent actual vehicle moving speed to be constant in the video is critical when the video is played at a constant normal video playback speed. To reach this goal, the distance traveled per frame should be constant throughout the video. During the route video recording, it is inevitable that the video recording vehicle is sometimes slower than target recording vehicle speed, and sometimes it is faster. That means in the video, some video sections have slower actual recording vehicle speed, and some video sections have faster actual recording vehicle speed. Thus, the video needs to be processed to adjust for the variable actual recording vehicle speed.

When in one section the video recording vehicle actual speed is slower than target speed, which means in this video section average frame to frame distance traveled is shorter than that at target speed, frames will be removed; when in one section the video recording vehicle actual speed is faster than target speed, which means in the video average frame to frame distance traveled is longer than that of target speed, frames will added.

After the process starts at 1100, target vehicle speed for the video is chosen at 1102, with the actual vehicle speed and video recording speed (fps: frame per second) collected at 1103. After target recording vehicle speed, video recording speed and actual recording vehicle speed are chosen or collected, the video sections whose actual recording vehicle speed is different from target recording vehicle speed are identified at 1104. Also, at 1104, the recorded video is broken into discrete sections whenever the difference between actual recording vehicle speed and target recording vehicle speed changes between two of zero, negative and positive. See Table 1 for an example of section breaks.

TABLE 1

| Target Recording Vehicle Speed (kph) | Successive Actual Recording Vehicle Speed (kph) | Speed Differential (Actual – Target) (kph) | Section Break? |
|---|---|---|---|
| 20 | 20 | 0 | |
| 20 | 20 | 0 | |
| 20 | 15 | −5 | Yes |
| 20 | 18 | −2 | |
| 20 | 16 | −4 | |
| 20 | 20 | 0 | Yes |
| 20 | 25 | 5 | Yes |
| 20 | 23 | 3 | |
| 20 | 20 | 0 | Yes |

After 1104, the first frame (starting frame) of each of these discrete video sections is identified at 1105.

After the starting frame of a video section is identified, the frame-to-starting frame distance traveled at target recording vehicle speed is calculated at 1106. The frame-to-starting frame distance traveled at actual recording vehicle speed in the video is calculated as well at 1108. The frame-to-starting frame distances calculated in 1106 and 1108 are compared at 1110. Steps 1102 to 1108 can occur in any order such that the results need in 1110 are obtained.

If step 1112 determines that in a section the video recording vehicle actual speed is slower than the target recording vehicle speed, then at 1114, the frames with the closest distance to those of target vehicle speed frames are marked with Y. At 1116, frames between the Y marked frames are marked with N.

When the actual recording vehicle speed is faster than target recording vehicle speed for a section at 1112, then at 1118 all frames in this section with are marked Y. At 1120, determine the number of frames that must be added between frames marked with Y to achieve the targeted distance traveled between frames determined in 1106. At 1122, add frames between each frame marked with Y in 1118 and at 1123 mark the new frames with YY.

If the actual vehicle speed matches the target vehicle speed at 1112, then all frames are marked with Y and no further work is needed before step 1125.

At 1125, data files F1 and F2 are generated. Date file F1 and F2 are the files at step 910 and 912 respectively in FIG. 9. Data file F1 contains all frames marked Y. Data file F2 will be generated with frames with N and YY. This separate data file will be used to remove and add video frames to the video file at step 916. The video calculation process is completed at 1126.

The frame markings, file names and other specific designators provided in the figures are examples only and any designator may be used. It should also be considered that the determinations and functions throughout may be performed by humans, computers or other means. Additionally, other process flows that have the same result may involve other than two data files, e.g. all frames and data may be in one file that is then processed to produce the final video or three files may be used to contain Y, YY and N frames in separate files.

The invention description provided can also be adapted for use with rowing machines or swim trainers with the video recording vehicle may be any device including a motorized or non-motorized boat and drone or a human being.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the provided claims.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed:

1. An interactive training system for an exercise training apparatus, comprising:

a processor with memory, data storage and interface;

a controller communicatively coupled to the processor;

a video recording device for simultaneously recording a video, video data of the exercise route, and GPS data of the exercise route, wherein the GPS data includes GPS coordinates, recording vehicle moving speed, slope data, and elevation and the video data includes a video recording speed;

a video process device, wherein a video recording vehicle speed of a video recording vehicle, the video recording speed, a target vehicle speed, and a distance between each video frame are used to process the exercise route video to produce a processed video at the target vehicle speed;

at least one display for providing video playback of the processed video and interface communications between user and exercise training apparatus; and a resistance device communicatively coupled to the controller, wherein a combined resistance factor or an incline of the exercise equipment is determined by at least one of the following: location data, speed data or slope data.

2. The system of claim 1, wherein the exercise training apparatus is an exercise bicycle, treadmill, rowing machine or swim trainer.

3. The system of claim 1, wherein the video playback speed is determined by an exercise training apparatus speed when processed video moving speed and video recording speed are constant.

4. The system of claim 1, wherein a user can resume an unfinished ride or select any starting position of the processed video of the exercise route.

5. The system of claim 1, wherein the exercise training apparatus can be controlled by mobile device, computer, or controller integrated with the exercise training apparatus.

6. The system of claim 1, wherein the route video of the processed video continues to be played back to a user when the combined resistance factor is negative or zero.

7. The system of claim 1, wherein the exercise route video is processed in sections by the video process device by analyzing the difference between an actual video recording vehicle speed and the target vehicle speed changes between two of zero, negative and positive.

8. The system of claim 7, wherein one or more video frames in a section of the video file is removed when the actual video recording vehicle speed is slower than the target vehicle speed in the section of the video file or one or more video frames is added when the actual video recording vehicle speed is faster than the target vehicle speed in the section of one or more video frames of the video file.

9. The system of claim 8, wherein the distance between frames and section starting frame in a section is calculated based on actual vehicle speed.

10. The system of claim 8, preferred distance between each frame and section starting frame is calculated based on preferred constant moving distance per frame.

11. The system of claim 8, wherein the video process device compares a target frame to section starting frame distance to the actual frame to section starting frame distance and keeps the actual frames with distance closest to the preferred target frames.

12. The system of claim 11, wherein the actual distance and preferred distance between frames and section starting frame are compared and all frames are kept by the video processing device by adjusting playback speed variably.

13. The system of claim 1, wherein the processed video and one or more additional content files are compiled into a route content package, wherein the one or more additional content files can include at least one of the following: one or more files with geographic data, slope data, audio files, or graphics files.

14. The system of claim 13, wherein once a route content package is selected, the resistance device sets an initial resistance to the exercise training apparatus and then the combined resistance factor is utilized to vary the resistance applied by the resistance device automatically as a user performs the exercise route of the selected route content package.

15. The system of claim 13, wherein the video process device is a computer.

16. The system of claim 1, wherein the target vehicle speed and video recording speed are determined by road speed limit.

17. The system of claim 1, wherein the slope data can be obtained by inclinometer or by calculation using elevation and distance data.

18. The system of claim 17, wherein the elevation data is acquired by one or more of the following: a GPS device or satellite geographic data.

19. The system of claim 1, wherein the combined resistance factor is determined by at least one of the following: slope, exercise apparatus speed, user profile, road friction resistance, or wind speed.

20. The system of claim 1, wherein the video recording vehicle is used to transport the video recording device, wherein the video recording vehicle can be selected from one of the following: a motorized vehicle, non-motorized vehicle, motorized boat, non-motorized boat or a drone.

* * * * *